US007553040B2

(12) United States Patent
Boothe et al.

(10) Patent No.: US 7,553,040 B2
(45) Date of Patent: Jun. 30, 2009

(54) UNDERWATER POOL LIGHT

(75) Inventors: Brian J. Boothe, Raleigh, NC (US); Kenneth K. Leis, Waukesha, WI (US)

(73) Assignee: Pentair Water Pool and Spa, Inc., Sanford, NC (US)

( * ) Notice: Subject to any disclaimer, the term of this patent is extended or adjusted under 35 U.S.C. 154(b) by 49 days.

(21) Appl. No.: 11/599,630

(22) Filed: Nov. 14, 2006

(65) Prior Publication Data

US 2008/0112157 A1 May 15, 2008

(51) Int. Cl.
*F21V 33/00* (2006.01)

(52) U.S. Cl. ..... 362/101; 362/264; 362/267; 362/276; 362/293; 362/308

(58) Field of Classification Search ..... 362/101, 362/264, 267, 294, 308, 328, 276, 293
See application file for complete search history.

(56) References Cited

U.S. PATENT DOCUMENTS 4,503,489 A * 3/1985 Duerr et al. ..... 362/101
5,051,875 A * 9/1991 Johnson ..... 362/101

* cited by examiner

*Primary Examiner*—Stephen F Husar
(74) *Attorney, Agent, or Firm*—Greenberg Traurig LLP

(57) ABSTRACT

An underwater light that can include a mounting assembly attachable to a pool wall without having to make a niche in the wall, a housing coupled to the mounting assembly and including a light source cavity, a reflector in the light source cavity, a light source in front of the reflector, and a lens in front of the light source. The lens can include a plurality of contiguous parallel concave lens elements extending in a single direction to disperse light perpendicular to the single direction. The underwater light can include a removable lens cover that is at least one of red, green, yellow, and blue, in order to shine colored light into the pool.

27 Claims, 9 Drawing Sheets

UNDERWATER POOL LIGHT

BACKGROUND

Underwater pool lights are used in swimming pools, wading pools, fountains and spas for illumination under the surface of the water. Underwater pool lights generally require a niche in a wall of the pool for installation of the light. This requires extra excavation and concrete reinforcing or extra gunite to install the light in a gunite pool. As a result, most underwater lights are bulky and expensive to install. In vinyl liner pools, additional reinforcing is usually required, and large holes, nine to twelve inches wide, are needed to install wet niche lights. This type of installation also increases the chance of leaks in vinyl liner pools. Many conventional lights cannot be used in vinyl liner pools.

Some underwater lights must be removed and completely disassembled to replace a bulb, adding to their inconvenience and requiring experienced personnel for maintenance. Other underwater lights have no heat sensing device to prevent overheating. Besides presenting a safety hazard, overheating reduces bulb life and increases maintenance costs.

Some underwater lights use clear covers or lenses and provide no directional control over the light output. These lights have a tendency to illuminate not just the pool but also the surrounding area. The resulting glare is both an inconvenience and a safety hazard. Fountain lights also should be appropriately directed to avoid unwanted glare. Underwater lights should include an effective reflector to direct light out into the pool.

SUMMARY

In light of the above, a need exists for underwater pool lights that are flush mounted, allow for easy and safe maintenance, operate for extended periods of time without requiring maintenance, and/or direct light in a specified direction.

Some embodiments of the invention provide an underwater pool light for attachment to a wall of a pool with a mounting assembly that attaches to the wall without having to make a niche in the wall. A housing having a light source cavity can be coupled to the mounting assembly. The light can also include a reflector coupled to the housing in the light source cavity, a light source positioned in the light source cavity in front of the reflector, and a lens coupled to the housing in front of the light source. The lens can include a plurality of contiguous parallel concave lens elements extending in a single direction to disperse light perpendicularly to the single direction.

Another embodiment of the invention provides an underwater pool light with a removable lens cover. The lens cover can be red, green, yellow, or blue in order to shine colored light into the pool.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
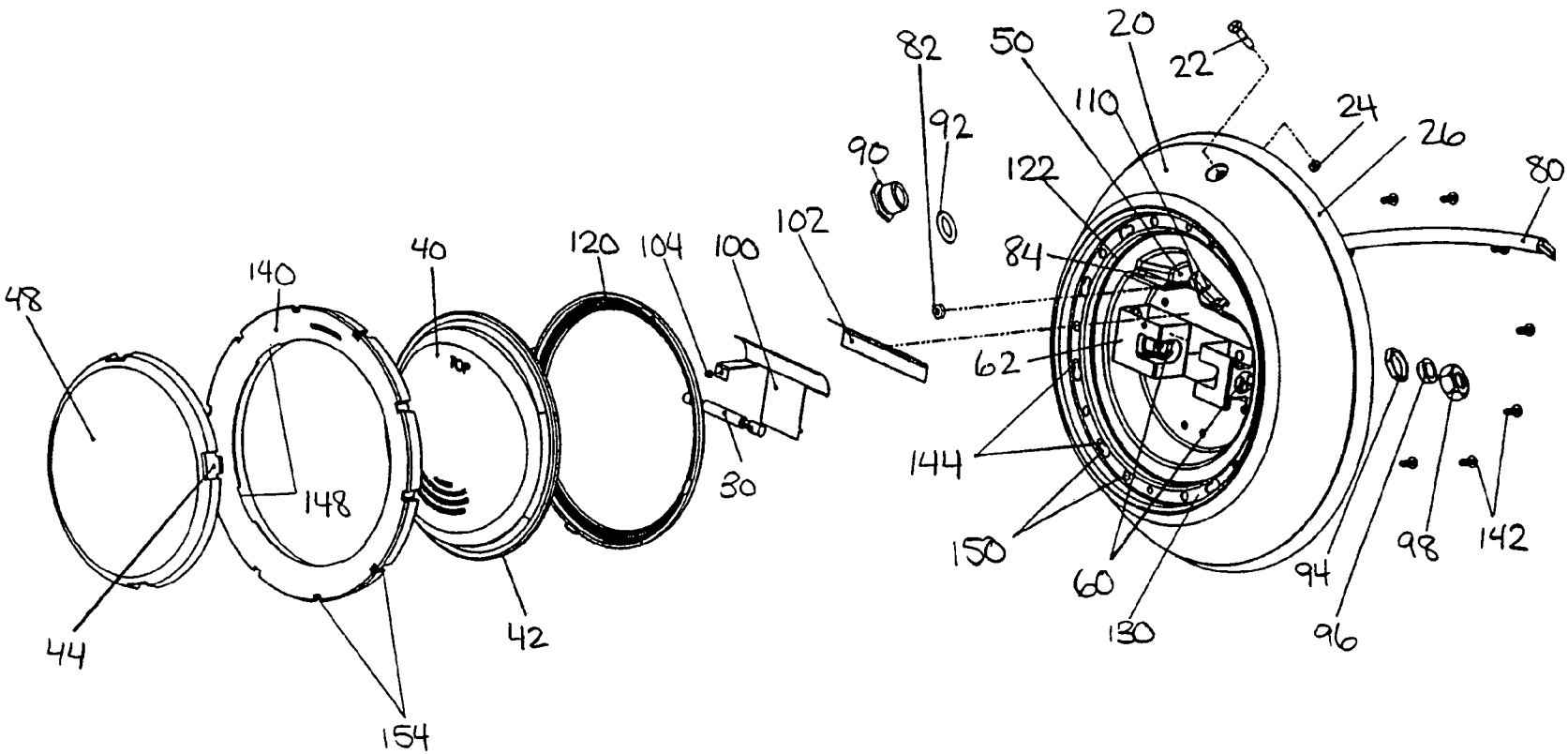
FIG. 1 is an exploded perspective view of an underwater pool light assembly according to one embodiment of the invention.

FIG. 1 illustrates an underwater pool light according to one embodiment of the invention. The underwater pool light can include a housing 20, a light source 30, a temperature sensor 110, and a lens 40.

Figure 2A:
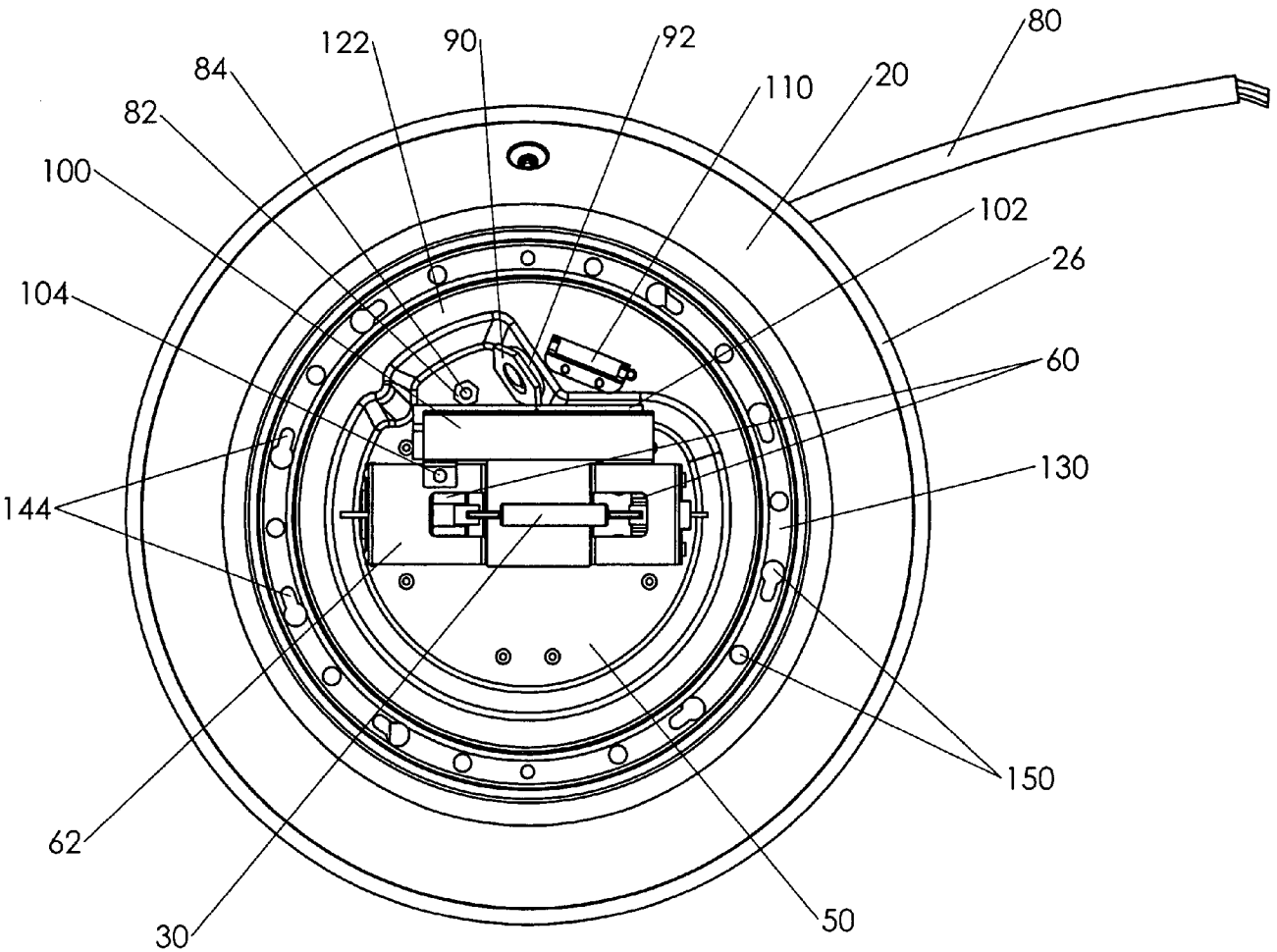
FIG. 2A is a front elevational view of a housing of the underwater pool light of FIG. 1.
Figure 2B:
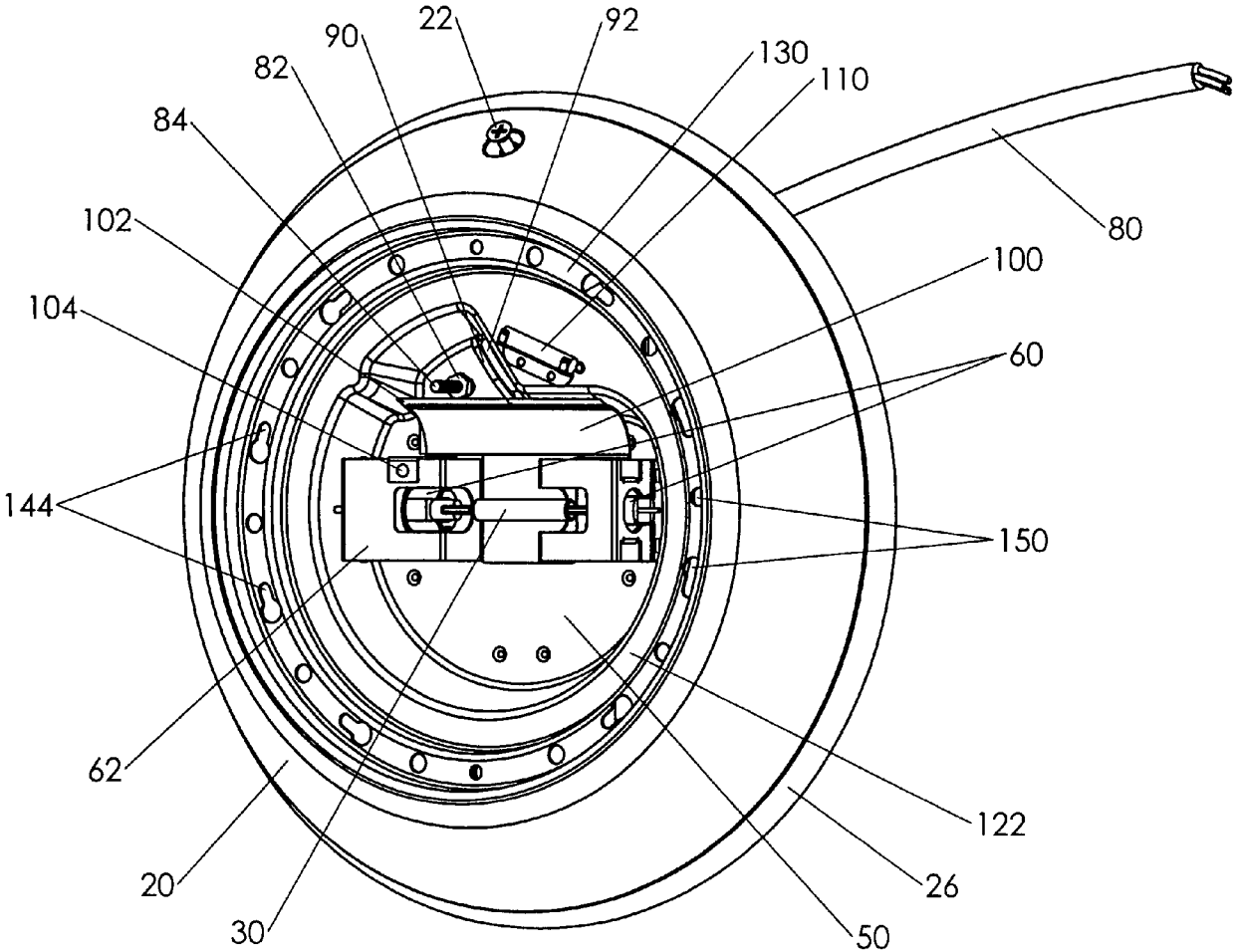
FIG. 2B is a front perspective view of the housing of FIG. 2A.

As shown in FIGS. 1, 2A, and 2B, the housing 20 can include a recessed light source cavity 50. The light source cavity 50 can include a socket 60, which can have a spring-loaded portion and a stationary portion. The socket 60 can receive the light source 30 such as a halogen bulb. The light source cavity 50 can also include a socket mount 62 partially surrounding the socket 60, and power circuitry (not shown). During manufacture, the power circuitry is partially sealed in epoxy (not shown) in an area bounded by the walls of the light source cavity 50 and a strip of aluminum tape 102. The aluminum tape 102 is removed after the epoxy cures. A ground stud nut 82 can engage a grounding pin 84 to connect the power circuitry to the housing 20.

As shown in FIGS. 2A and 2B, a reflector 100 can be positioned behind or adjacent to the light source 30 in order to direct light outward. The reflector 100 can be secured to the socket mount 62 with a rivet 104, in one embodiment. A temperature sensor 110 can be connected (in series with the light source 30) to the power circuitry in order to disconnect power in the event that the underwater pool light over-heats. The front face of the housing 20 can include a gasket seat 122 around the perimeter of the light source cavity 50.

Figure 3A:
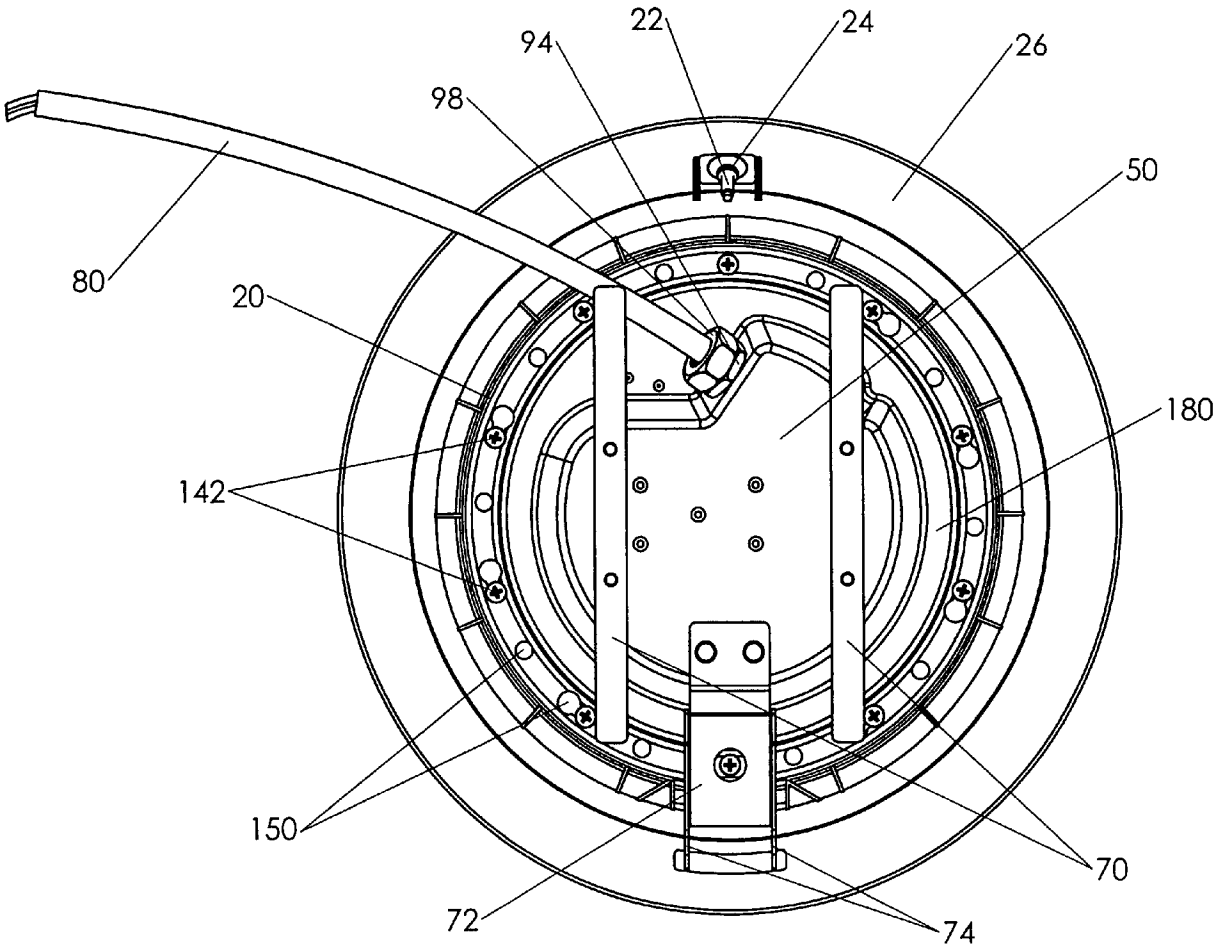
FIG. 3A is a rear elevational view of the housing of FIG. 2A.
Figure 3B:
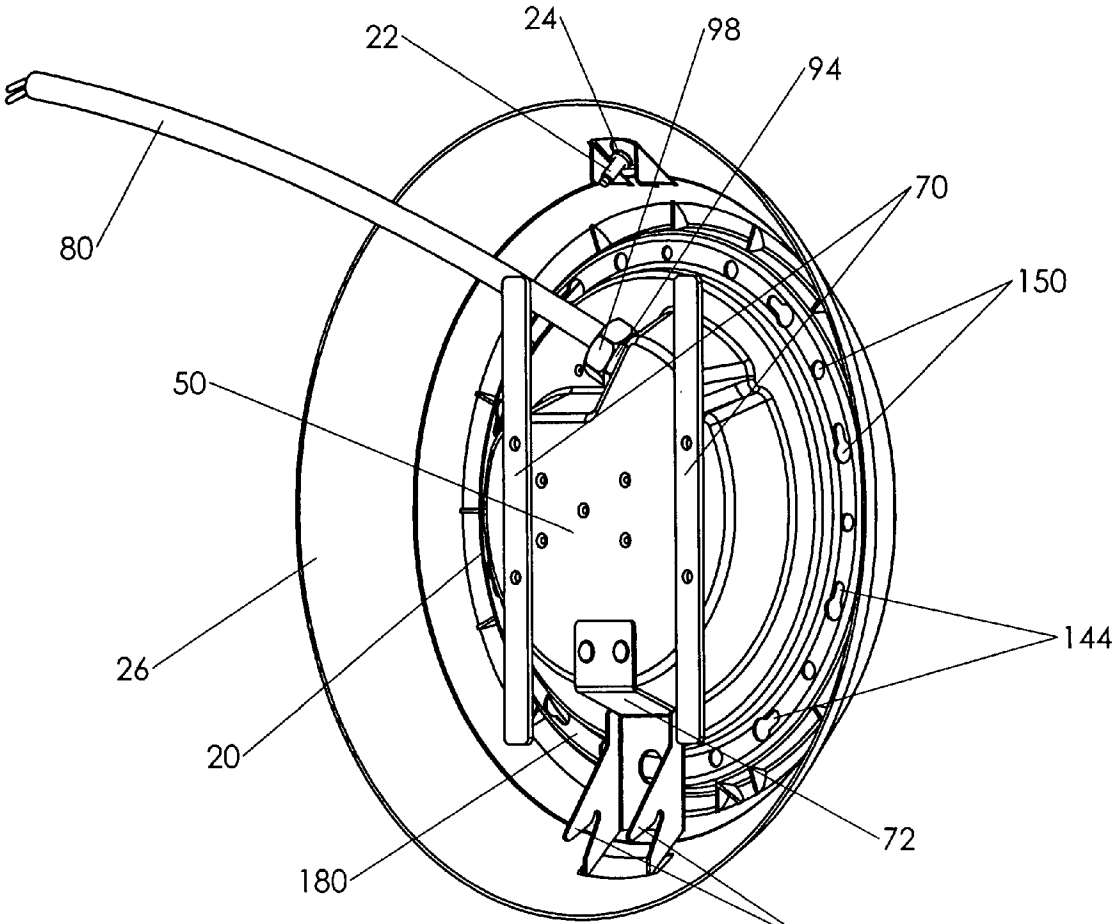
FIG. 3B is a rear perspective view of the housing of FIG. 2A.

As shown in FIGS. 1, 2A, and 2B, a power cord 80 can be connected from the rear of the housing 20 to the light source cavity 50. As shown in FIGS. 2A and 2B, a liquid tight connect (LTC) body 90 can connect the power cord 80 to the housing 20. An o-ring 92 can create an annular seal between the housing 20 and the LTC body 90. FIGS. 3A and 3B illustrate that the power cord 80 can be secured in a water-tight manner to the light source cavity 50 using a jam nut 94 and a nut 98. The jam nut 94 and nut 98 can be coupled to the LTC body 90 with a cord cone washer 96 that can create an annular seal between the power cord 80 and the nut 98. The LTC body 90 and cord cone washer 96 that are shown in the embodiment of FIG. 1 can be hidden from view in the assembled housing of FIGS. 3A and 3B by the jam nut 94 and the nut 98.

As shown in FIGS. 3A and 3B, the rear face of the housing 20 can include a storage area 180 for a portion of the power cord 80, which can also facilitate repair and maintenance of the underwater pool light. The cord storage area 180 can be located adjacent to the rear face of the housing 20 and can surround a wall that forms the light source cavity 50. In one embodiment, two parallel bars 70 can be attached to the rear face of the light source cavity 50 and can extend almost to the edge of the housing 20, leaving sufficient clearance for the power cord 80 to be wound around the light source cavity 50 and under the bars 70. As a result, the bars 70 can hold the unused portion of the power cord 80 in place.

Figure 6:
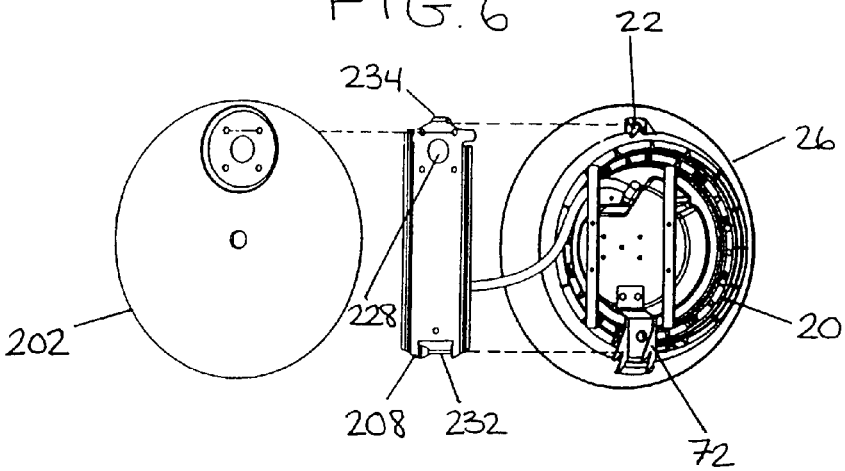
FIG. 6 is a perspective view of the underwater pool light of FIG. 1, a wall bracket, and a mounting spacer.

FIGS. 3A and 3B also illustrate a mounting bracket 72 attached to the rear face of the housing 20 and extending from the light source cavity 50 radially toward the edge of the housing 20. The mounting bracket 72 can have prongs 74 for engaging a wall bracket 208, as illustrated in FIG. 6. Opposite the mounting bracket 72, a captive screw 22 (shown in FIGS. 2B, 3A, and 3B) can be inserted from the front of the housing 20 through an aperture in the housing 20. The captive screw 22 can also be inserted through a housing spacer 26 to secure the housing 20 to a wall bracket 208. As shown in FIGS. 3A and 3B, a gum washer 24 can be used to hold the captive screw 22 in place with respect to the housing 20.

Figure 4A:
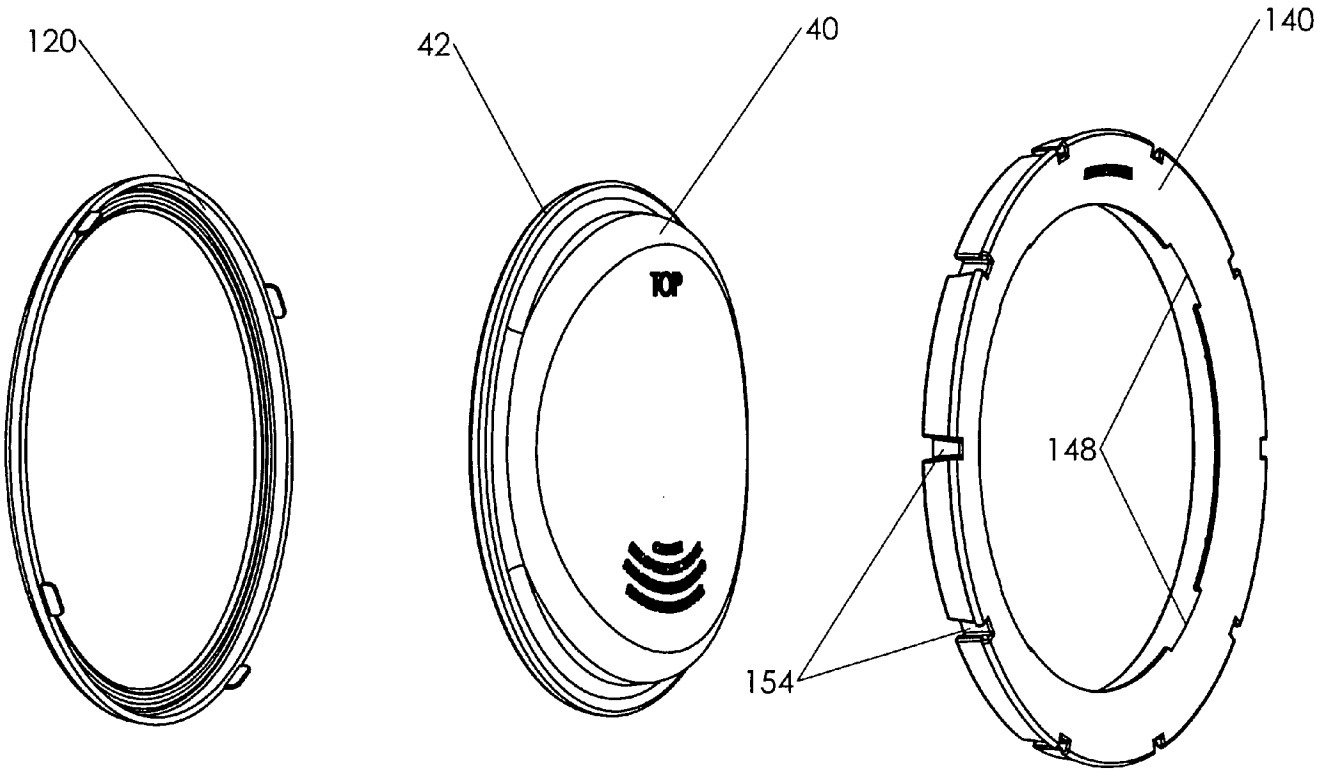
FIG. 4A is a front exploded perspective view of a pool light lens, face ring, and gasket for use with the underwater pool light of FIG. 1.
Figure 4B:
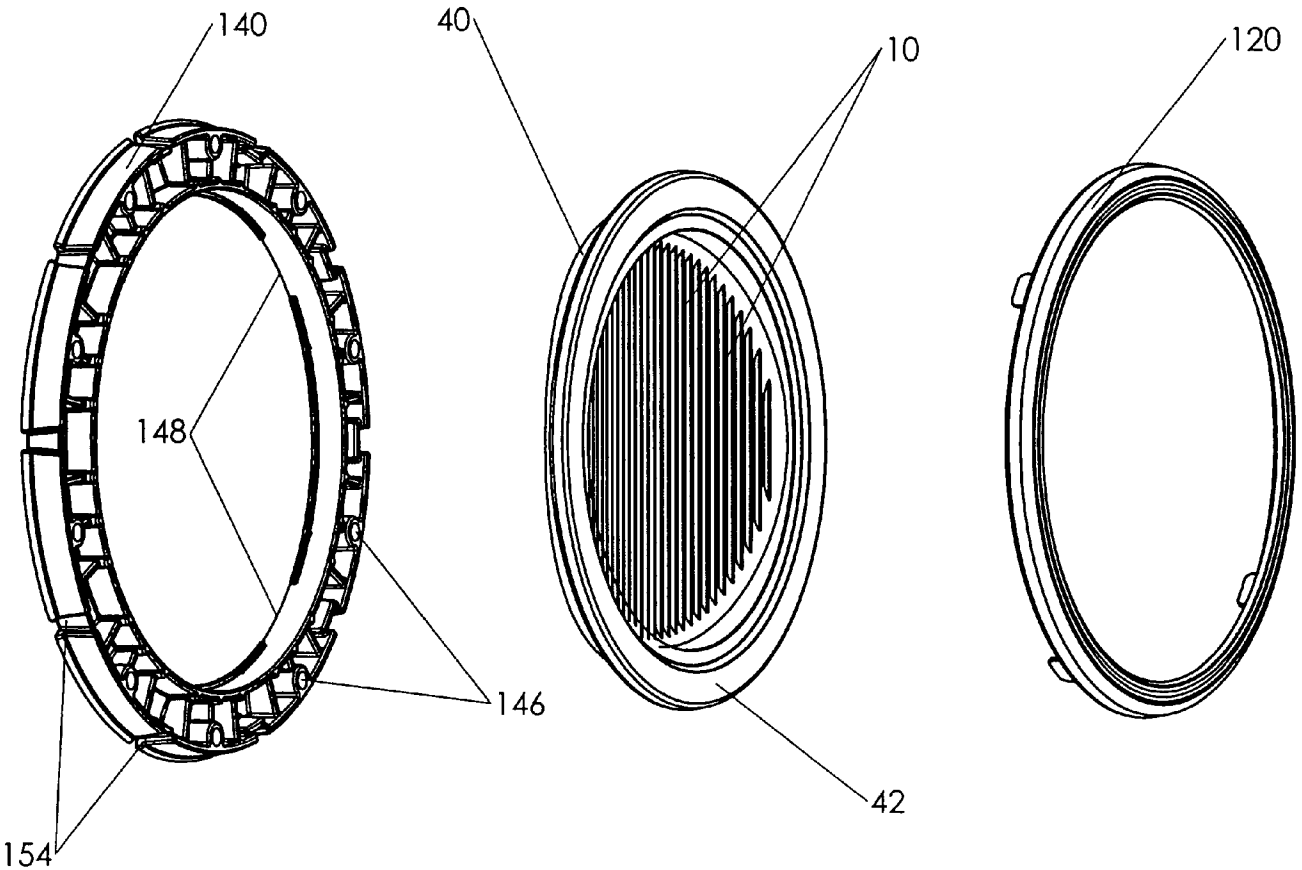
FIG. 4B is a rear exploded perspective view of the pool light lens, face ring, and gasket of FIG. 4A.

As shown in FIG. 4A, the lens 40 can include a lens flange 42, which can be positioned in a plane parallel to that of the pool wall. The front face of the lens 40 can be saddle-shaped and substantially smooth. FIG. 4B illustrates that the rear face of the lens 40 can include several lens elements 10. The lens elements 10 can be contiguous, parallel, cylindrical, and/or concave in shape and orientation. The lens elements 10 can also extend in a single direction, which is typically vertical in order to disperse the light perpendicular to the single direction. The lens elements 10 can fan the light out horizontally.

The housing 20 can be removable and can have a one-piece construction. As shown in FIGS. 1-2B, a rim 130 can be included in a portion of the housing 20 that extends radially beyond the gasket seat 122. Liquid in the pool can pass from the front face of the housing 20 through openings 150 in the rim 130 to surround and cool the light source cavity 50. A gasket 120 illustrated in FIG. 1 can be used to form a seal between the gasket seat 122 on the front face of the housing 20 and the lens flange 42.

Figure 5:
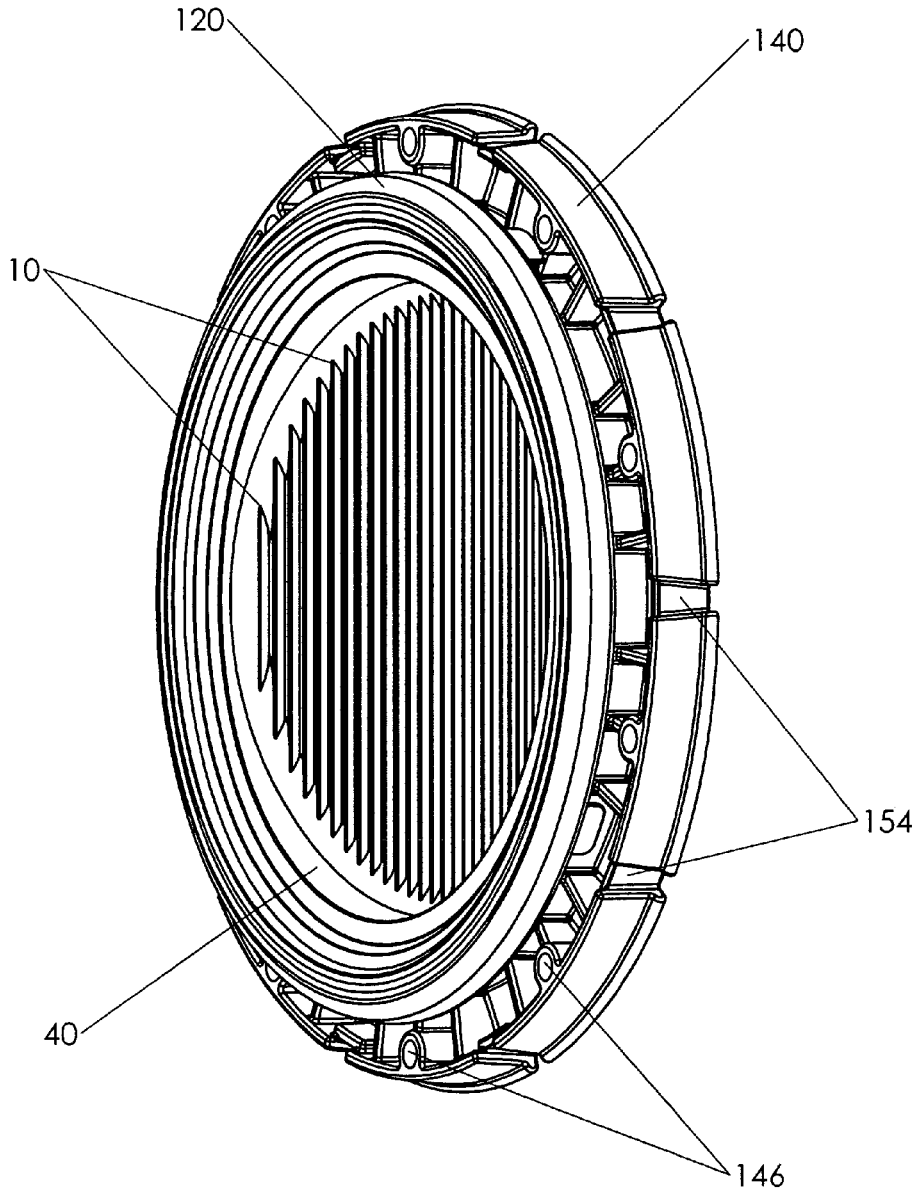
FIG. 5 is a rear perspective view of the pool light lens, face ring, and gasket of FIG. 4A.

FIG. 5 illustrates how a face ring 140, the lens 40, and the gasket 120 can fit together when the underwater pool light is assembled. These components can be secured to the housing 20 shown in FIGS. 1, 2A, and 2B with screws 142 that pass through holes 144 in the rim 130. The screws 142 can be received by threaded holes (not shown) in bosses 146 on the rear of the face ring 140 shown in FIG. 4B. Tightening the screws 142 can secure the gasket 120, the lens 40, and the face ring 140 to the front face of the housing 20.

As illustrated in FIGS. 4A, 4B, and 5, the outer perimeter of the face ring 140 can be formed with notches 154 which provide access to the rim 130 for the circulation of cooling pool liquid. The inner perimeter of the face ring 140 can also be formed with notches 148 to receive connecting tabs 44 of a lens cover 48 (shown in FIG. 1), while also providing access to the lens 40 for circulation of cooling pool liquid.

As shown in FIG. 6, a wall bracket 208 can be used to mount the underwater pool light flush with a wall of a vinyl liner pool. The wall bracket 208 can be formed from a flat piece of metal and can include an aperture 228 that the power cord 80 can pass through. The wall bracket 208 can also have retaining features 232 and 234 that can be engaged by the mounting bracket 72 and the captive screw 22, respectively. The wall bracket 208 can be offset from the vinyl liner with a mounting spacer 202. As shown in FIG. 6, the mounting spacer 202 can be the same shape and size of the projection of the underwater pool light on the pool wall in order to protect the vinyl from being damaged by the wall bracket 208 or any other part of the underwater pool light.

Figure 7:
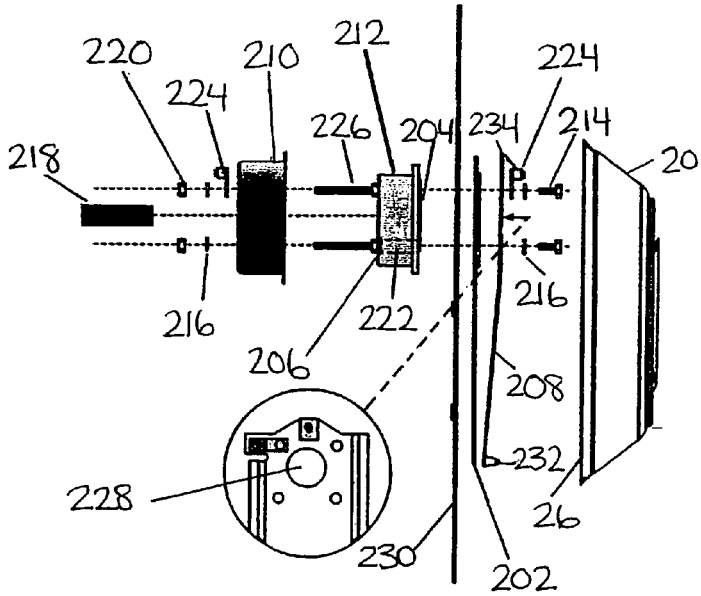
FIG. 7 is an exploded side view of a mounting assembly for the underwater pool light of FIG. 1.

FIG. 7 illustrates a mounting assembly that can be used to secure the wall bracket 208 to the pool wall in one embodiment of the invention. In addition to the components shown in FIG. 6, the mounting assembly can include a mounting hub 212, a flange 210, a toe nipple 218, and associated hardware components. In some embodiments, holes in both the pool wall and a vinyl liner 230 can be cut or punched out and the mounting hub 212 can be positioned between the pool wall and the vinyl liner 230 in order to provide a passageway for the power cord 80. The toe nipple 218, having a hollow cylindrical shape, can extend through the length of this passageway from outside the pool wall to the mounting hub 212. As a result, the surrounded power cord 80 can be electrically isolated.

As also shown in FIG. 7, the mounting hub 212 can have studs 226 extending toward the holes in the pool wall. The studs 226 can be threaded and of sufficient length to extend through the pool wall when the mounting assembly is fully secured. The mounting hub 212 can be offset from the pool wall with standoffs 222. O-rings 206 can provide a seal between the standoffs 222 and the pool wall. A gasket 204 can be positioned between the mounting hub 212 and the vinyl liner 230 in order to seal the hole in the vinyl liner 230 that the power cord 80 passes through. On the exterior side of the pool wall, the flange 210 can receive the studs 226. Lock washers 216 and nuts 220 can be threaded onto the studs 226 and tightened to anchor both the flange 210 and the mounting hub 212 to the pool wall. Additionally, grounding lugs 224 can be secured to the flange 210 and the wall bracket 208 in order to provide electrical grounding for the pool light. As shown in FIG. 7, the wall bracket 208 can be secured to the mounting hub 212 with mounting screws 214 and lock washers 216.

This application incorporates U.S. Pat. No. 5,051,875 herein by reference in its entirety. Various features and advantages of the invention are set forth in the following claims.

The invention claimed is:

1. An underwater light for attachment to a wall of a pool, the underwater light comprising:

a mounting assembly that attaches to the wall without having to make a niche in the wall;

a housing coupled to the mounting assembly, the housing including a light source cavity and a recessed gasket seat;

a reflector coupled to the housing in the light source cavity;

a light source positioned in the light source cavity in front of the reflector;

a gasket positioned in the recessed gasket seat;

a lens received within in the gasket and positioned in front of the light source, the lens including a plurality of contiguous parallel concave lens elements extending in a single direction to disperse light perpendicular to the single direction;

a face ring positioned over the gasket and the lens and coupled to the housing, the face ring including at least one notch; and a removable lens cover including at least one tab to be received in the at least one notch, the removable lens cover positioned in front of the lens and being at least one of red, green, yellow, and blue in order to shine colored light into the pool.

2. The underwater light of claim 1 and further comprising a temperature sensor coupled to the housing in order to disconnect the light source from power when the underwater light overheats.

3. The underwater light of claim 2 wherein the temperature sensor is spaced from the light source.

4. The underwater light of claim 1 wherein the housing includes at least one opening that allows liquid to circulate behind the light source cavity.

5. The underwater light of claim 1 wherein the housing includes a power cord storage area.

6. The underwater light of claim 1 wherein the mounting assembly mounts the underwater light to a gunite pool wall.

7. The underwater light of claim 1 wherein the mounting assembly mounts the underwater light to a vinyl liner pool wall.

8. The underwater light of claim 1 wherein the reflector is hyperbolic in shape.

9. The underwater light of claim 1 wherein the light source is a halogen bulb.

10. The underwater light of claim 1 wherein the light source is mounted parallel to a plane of the wall of the pool.

11. The underwater light of claim 1 wherein the reflector is coupled to the housing with at least one of a bracket, a rivet, and aluminum tape.

12. The underwater light of claim 1 wherein the lens includes a continuous outer perimeter that forms a seal with the gasket.

13. The underwater light of claim 1 wherein the plurality of contiguous parallel concave lens elements are located on a rear face of the lens.

14. An underwater light for attachment to a wall of a pool, the underwater light comprising:

a mounting assembly that attaches to the wall without having to make a niche in the wall;

a housing coupled to the mounting assembly, the housing including a light source cavity;

a reflector coupled to the housing in the light source cavity;

a light source positioned in the light source cavity in front of the reflector;

a lens coupled to the housing in front of the light source by a face ring; and a removable lens cover positioned in front of the lens and coupled to the face ring, the removable lens cover being at least one of red, green, yellow, and blue in order to shine colored light into the pool.

15. The underwater light of claim 14 and further comprising a temperature sensor coupled to the housing in order to disconnect the light source from power when the underwater light overheats.

16. The underwater light of claim 14 wherein the housing includes at least one opening that allows liquid to circulate behind the light source cavity.

17. The underwater light of claim 14 wherein the housing includes a power cord storage area.

18. The underwater light of claim 14 wherein the mounting assembly mounts the underwater pool light to a gunite pool wall.

19. The underwater light of claim 14 wherein the mounting assembly mounts the underwater pool light to a vinyl liner pool wall.

20. The underwater light of claim 14 wherein the reflector is hyperbolic in shape.

21. The underwater light of claim 14 wherein the light source is a halogen bulb.

22. The underwater light of claim 14 wherein the light source is mounted parallel to a plane of the wall of the pool.

23. The underwater light of claim 14 wherein the reflector is coupled to the housing with at least one of a bracket, a rivet, and aluminum tape.

24. The underwater light of claim 14 wherein the housing includes a recessed gasket seat and a gasket positioned in the recessed gasket seat, wherein the lens is positioned within the gasket, and wherein the lens includes a continuous outer perimeter that forms a seal with the gasket.

25. The underwater light of claim 14, wherein the face ring includes inner notches to receive the lens cover.

26. The underwater light of claim 14 wherein the lens includes a plurality of contiguous parallel concave lens elements extending in a single direction to disperse light perpendicular to the single direction.

27. The underwater light of claim 26 wherein the plurality of contiguous parallel concave lens elements are located on a rear face of the lens.

* * * * *